US005586786A

United States Patent [19]

Su

[11] Patent Number: 5,586,786

[45] Date of Patent: Dec. 24, 1996

[54] EASEL SHOW FILE DISPLAY BOOKS

[76] Inventor: Liang-Feng Su, 58, Ma Yuan West St., Taichung, Taiwan

[21] Appl. No.: 517,057

[22] Filed: Aug. 21, 1995

[51] Int. Cl.[6] ..... A47B 23/00

[52] U.S. Cl. ..... 281/33; 281/38

[58] Field of Search ..... 211/15.1, 29, 33, 211/36, 37, 51, 38; 402/4, 70, 72, 73, 76, 80 R

[56] References Cited

U.S. PATENT DOCUMENTS

| | | | |
|---|---|---|---|
| 3,270,449 | 9/1966 | Robbie | 281/33 X |
| 4,213,520 | 7/1980 | Sarna et al. | 281/33 X |
| 4,240,761 | 12/1980 | Jacobson | 281/33 X |
| 4,377,271 | 3/1983 | Smith | 281/33 X |
| 5,251,935 | 10/1993 | Bottiglieri | 281/33 X |

*Primary Examiner*—Willmon Fridie, Jr.

[57] ABSTRACT

A foldable cover is made of recyclable polypropylene. The cover has an outer movable plate, a positioning plate and an inner movable plate. The outer movable plate extends from one side of the positioning plate. The inner movable plate extends from the other side of the positioning plate. A crease line which is disposed at the outer edge of the inner movable plate defines a foldable outer end edge. A plurality of transparent envelopes are positioned by the positioning plate. Two reinforced ribs which are made of steel wire are imbeded in two longer side edge portions of the foldable cover. The reinforced ribs are enwrapped by soft plastic cloth with woven designs. The foldable outer end edge is turned upward to fasten the outer end edge of the outer movable plate. The inner movable plate becomes a bottom plate. The outer movable plate and the positioning plate are inclined.

1 Claim, 5 Drawing Sheets

EASEL SHOW FILE DISPLAY BOOKS

BACKGROUND OF THE INVENTION

The invention relates to a file display device, More particularly, the present invention relates to an easel show file display books.

There are many types of conventional file display devices with various functions and patterns for various business activities. A type of conventional file display device is shown in FIG. 1. The conventional file display device has an outer skin 40. The outer skin 40 contains a foldable plate 41, a holding plate 43 and a fixing plate 42 between the foldable plate 41 and the holding plate 43. A retaining block 431 is disposed at one end of the holding plate 43 in order to block the end edge of the foldable plate 41 while the foldable plate 41 is erected. The foldable plate 41, the holding plate 43 and the fixing plate 42 form a triangular side view while the conventional file display device is in the erecting state. A plurality of the transparent envelopes 30 are hung on the fixing plate 42 and the articles in the transparent envelopes 30 are displayed. While the conventional file display device is in the folding state, the transparent envelopes 30 are covered by the foldable plate 41. Since the outer skin 40 is made of a thick paperboard which is enclosed by two layers of soft plastics, the outer skin 40 has three layers. Thus the paperboard is in the middle layer. Some foldable plate 41 has a sponge plate so that the user can feel comfortable while touching the foldable plate 41. Since the total weight of the outer skin 40, the sponge plate and the articles in the transparent envelopes 30 are very heavy, the burden of the user should be overburdened. The file display device needs overabundant materials for manufacturing the outer skin 40. The cutting of the paperboard is the waste of the paperboard material. Thus many trees should be cut in order to prepare the paperboard. Other types of outer skins are made of thick plastics. The edge of the plastic outer skin may scrape the finger of the user.

SUMMARY OF THE INVENTION

An object of the invention is to provide an easel show file display books which is light-weighted so that the user can easily carry the easel show file display books without overburden.

Another object of the invention is to provide an easel show file display books which can be erected firmly while the easel show file display books is in the erecting state.

Accordingly, a foldable cover is made of recyclable polypropylene. The cover has an outer movable plate, a positioning plate and an inner movable plate. The outer movable plate extends from one side of the positioning plate. The inner movable plate extends from the other side of the positioning plate. A crease line which is disposed at the outer edge of the inner movable plate defines a foldable outer end edge. A plurality of transparent envelopes are positioned by the positioning plate. Two reinforced ribs which are made of steel wire are imbeded in two longer side edge portions of the foldable cover. The reinforced ribs are enwrapped by soft plastic cloth with woven designs. The foldable outer end edge is turned upward to fasten the outer end edge of the outer movable plate. The inner movable plate becomes a bottom plate. The outer movable plate and the positioning plate are inclined.

DETAILED DESCRIPTION OF THE INVENTION

Figure 1:
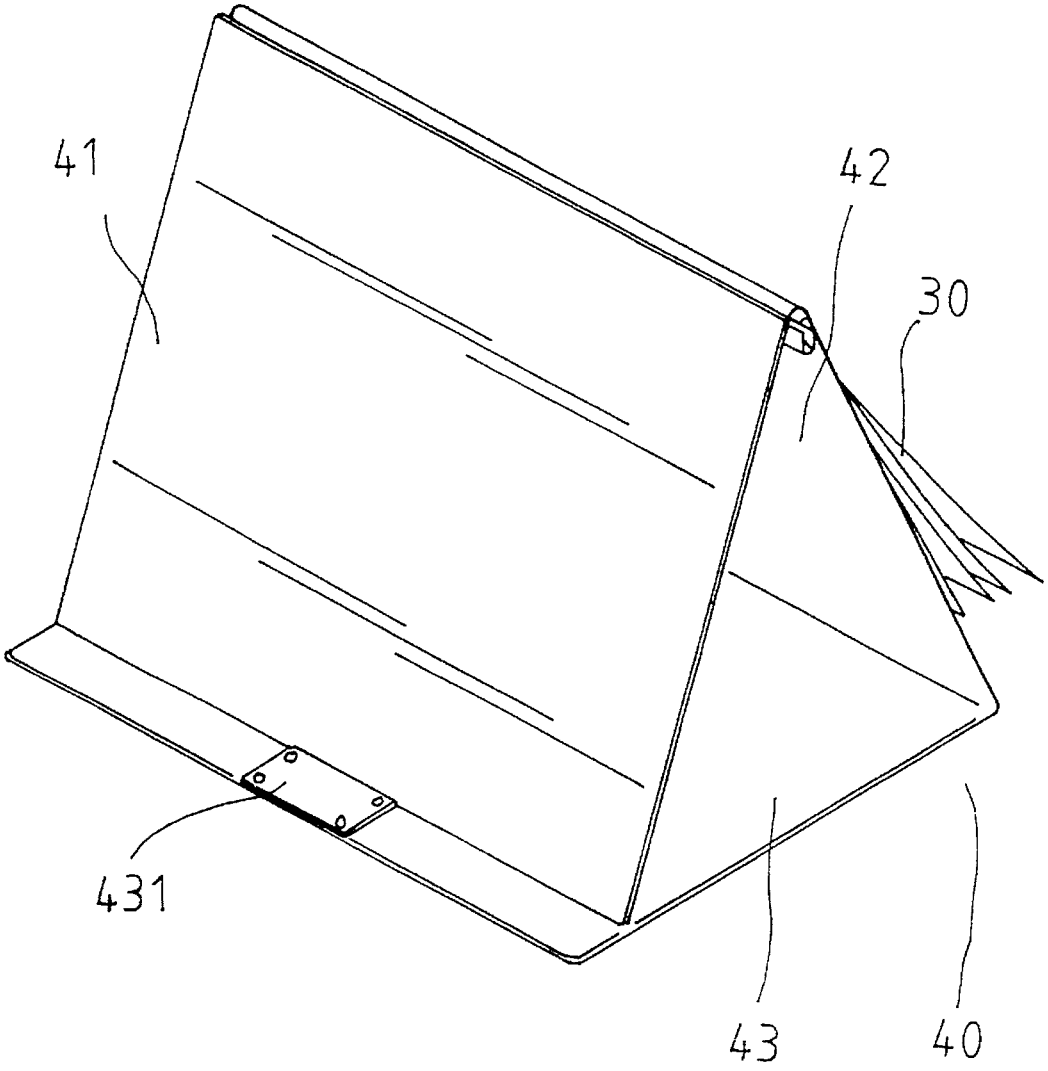
F I G. 1 PRIOR ART
FIG. 1 is a perspective view of a conventional file display device of the prior art.
Figure 2:
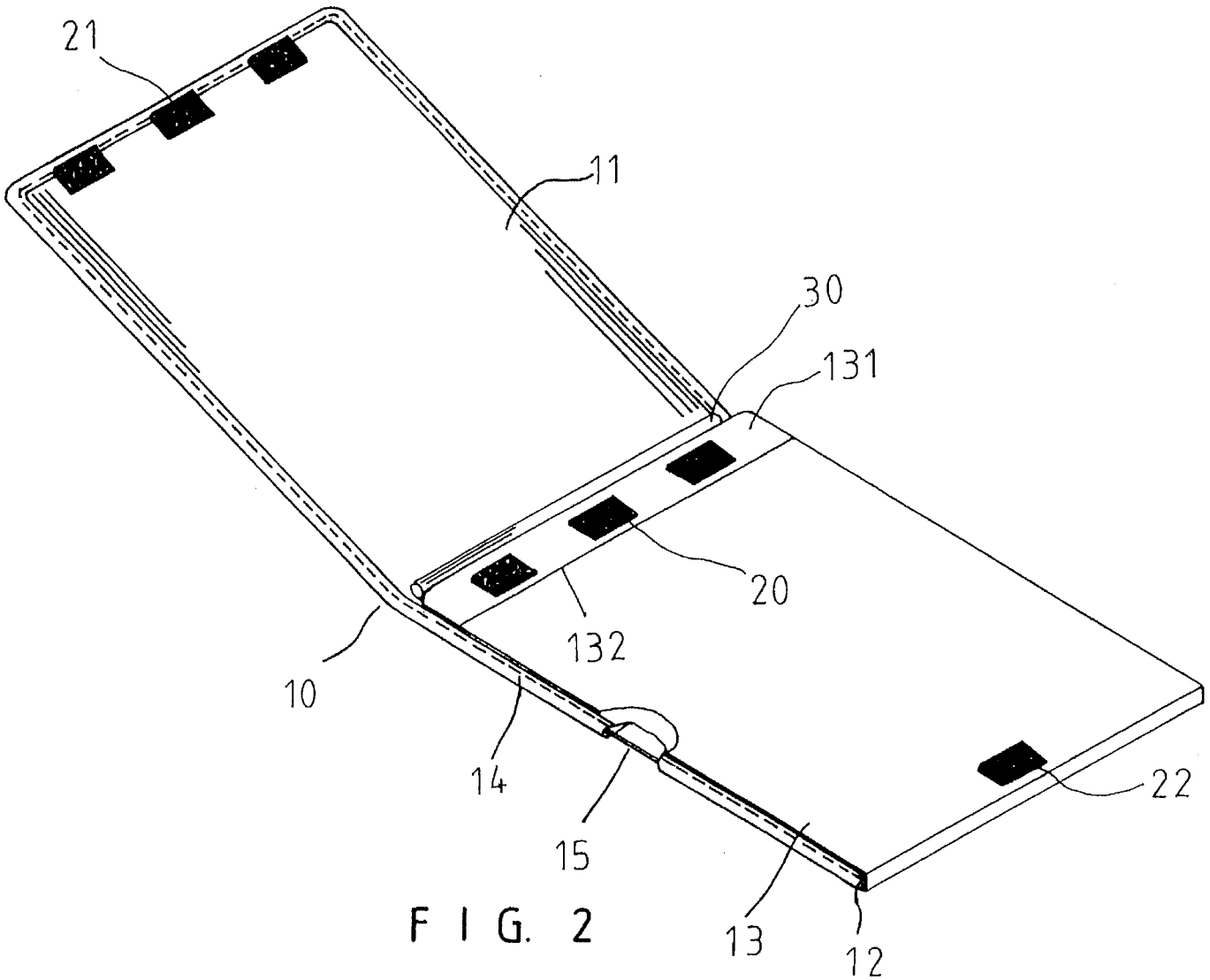
FIG. 2 is a perspective assembly view of an easel show file display books in accordance with the invention.
Figure 2A:
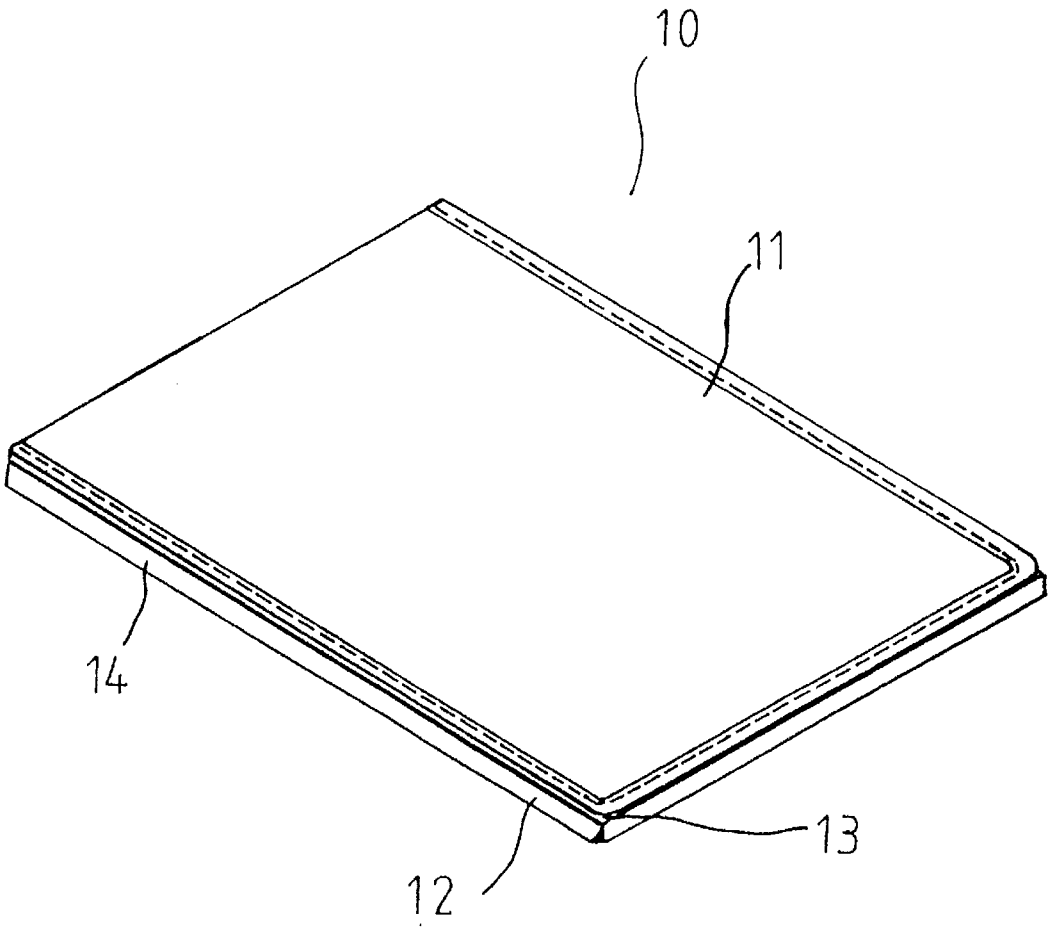
FIG. 2A is a perspective assembly view of an easel show file display books which is in the folding state.
Figure 3:
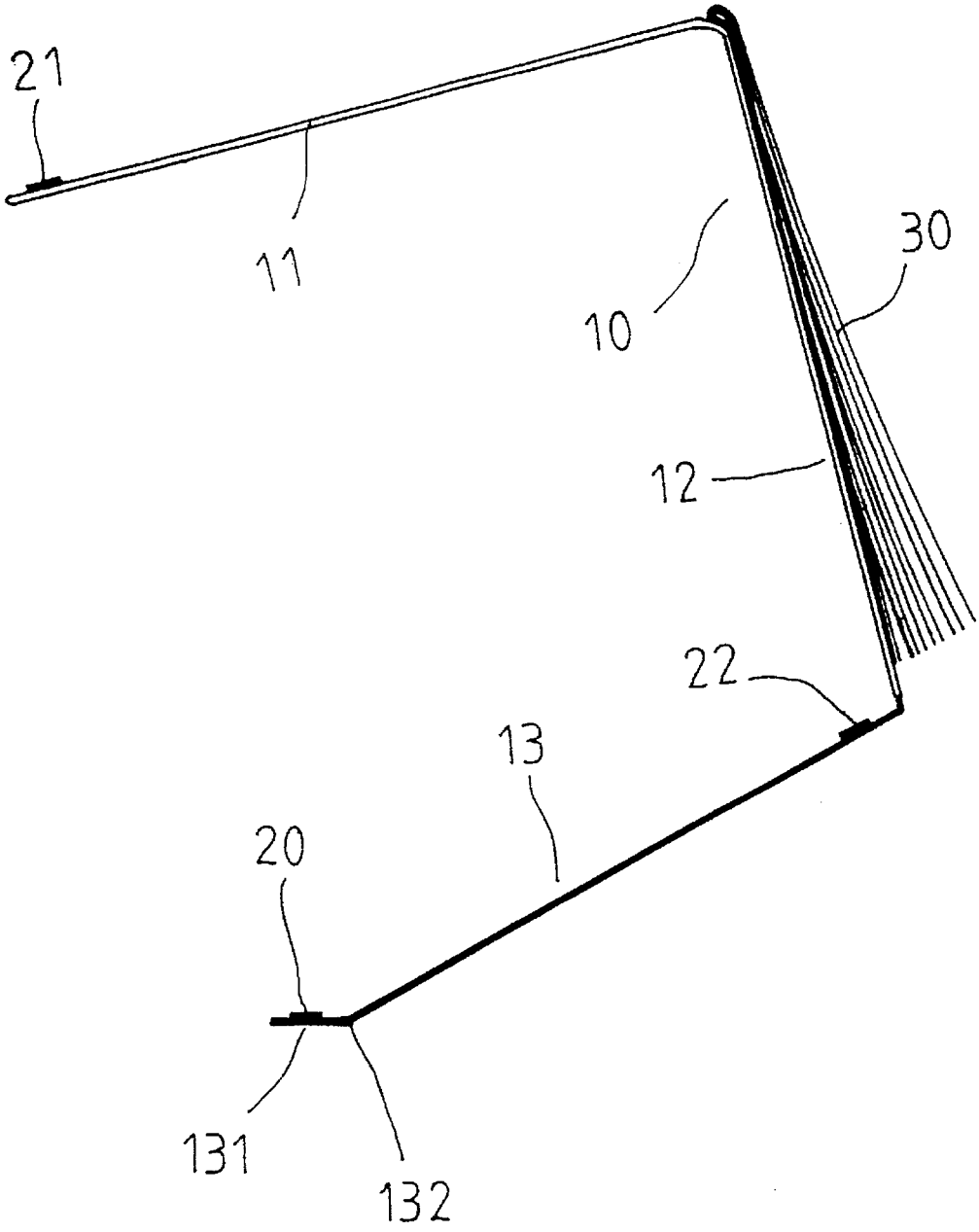
FIG. 3 is a side view of an easel show file display books while the easel show file display books is spreading out.
Figure 4:
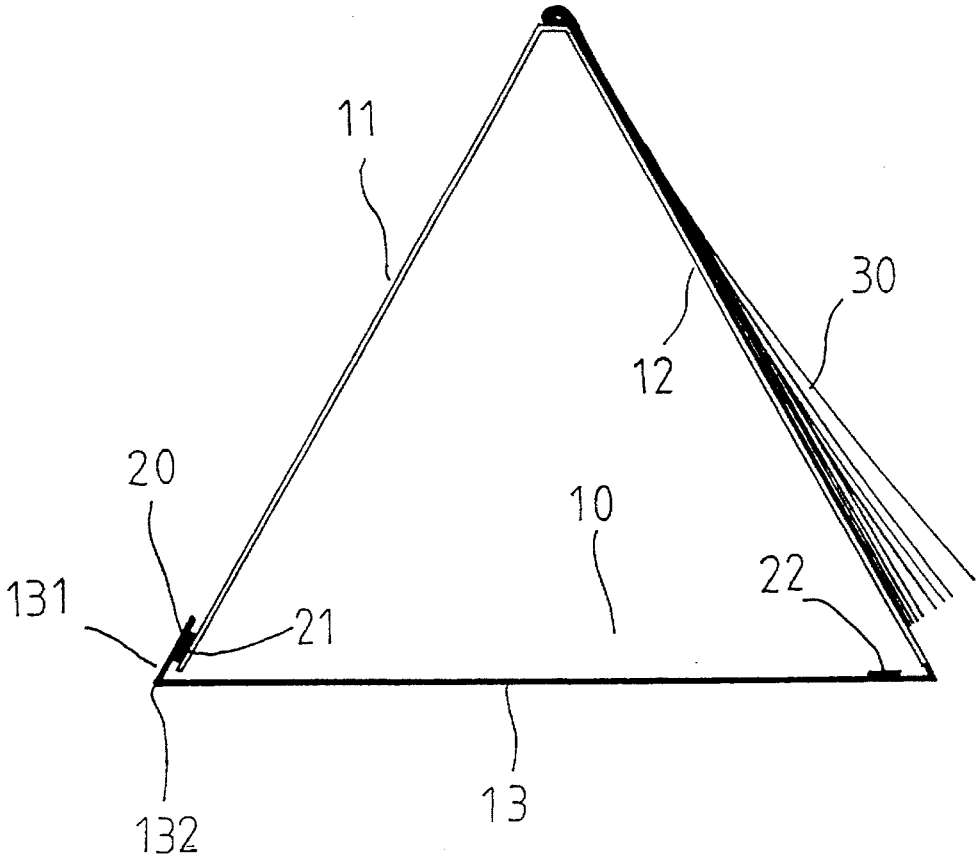
FIG. 4 is a side view of an easel show file display books while the easel show file display books is erecting.

Referring to FIGS. 2, 2A and 3, a foldable cover 10 is made of recyclable plastics such as polypropylene (PP). The cover 10 has an outer movable plate 11, a positioning plate 12 and an inner movable plate 13. The positioning plate 12 is disposed between the outer movable plate 11 and the inner movable plate 13. The outer movable plate 11 extends from one side of the positioning plate 12. The inner movable plate 13 extends from the other side of the positioning plate 12. A crease line 132 which is disposed at the outer edge of the inner movable plate 13 defines a foldable outer end edge 131. Three hook and loop tape 20 are disposed at the foldable outer end edge 131 of the inner movable plate 13. Another hook and loop tape 22 is disposed at the inner end edge of the inner movable plate 13. Three hook and loop tape 21 are disposed at the foldable outer end edge of the outer movable plate 13. A plurality of transparent envelopes 30 are enclosed by the positioning plate 12 and the inner movable plate 13. Each of the opposite side edge portions 14 has a reinforced rib 15 therein. Two reinforced ribs 15 which are made of steel or iron wire are imbeded in two longer side edge portions 14 of the foldable cover 10. The reinforced ribs 15 can be enwrapped by soft plastic cloth with woven designs. Thus the foldable cover 10 can be reinforced by the reinforced ribs 15.

Referring to FIG. 2A, one end of the transparent envelope 30 is positioned by the positioning plate 12. The inner movable plate 13 is turned inward to become a middle plate. The positioning plate 12 becomes the bottom plate. The outer movable plate 11 is turned inward to become an upper plate. Thus the transparent envelopes 30 are enclosed by the positioning plate 12 and the inner movable plate 13. The hook and loop type 21 of the outer movable plate 11 and the hook and loop type 22 of the inner movable plate 13 can be fastened together.

Referring to FIG. 3, one end of the transparent envelope 30 is positioned by the positioning plate 12 pivotably. The inner movable plate 13 is turned outward to become a bottom plate. The positioning plate 12 becomes the middle plate. The outer movable plate 11 is turned outward to become an upper plate. Thus the transparent envelopes 30 are positioned by the positioning plate 12 erectedly.

Referring to FIGS. 2 end 4, the side view of the foldable cover 10 is in a triangular shape. The three plates 11, 12 and 13 form a triangular side view. The foldable outer end edge 131 is turned, upward to fasten the outer end edge of the outer movable plate 11. The hook and loop type 21 of the outer movable plate 11 and the hook and loop type 20 of the inner movable plate 13 can be fastened together. The inner movable plate 13 becomes a bottom plate. The outer movable plate 11 and the positioning plate 12 are inclined. The top edge of the transparent envelopes 30 are positioned by the positioning plate 12.

The advantages of the invention are described as follows. The foldable cover 10 is made of PP which firm and light-weighted. The surface of PP is smooth so that the user can feel comfortable while touching the cover 10. The foldable outer end edge 131 fastens the outer end edge of the outer movable plate 11. The hook and loop type 21 of the outer movable plate 11 and the hook and loop type 20 of the inner movable plate 13 are fastened together so that the foldable cover 10 can erect steadily. The reinforced rib 15 can reinforce the foldable cover also.

The invention is not limited to the above embodiment but various modification thereof may be made. It will be understood by those skilled in the art that various changes in form and detail may be made without departing from the spirit and scope of the invention.

I claim:

1. A foldable cover is made of recyclable polypropylene, said cover comprising:

an outer movable plate;

a positioning plate;

an inner movable plate;

said outer movable plate extending from one side of said positioning plate, and said inner movable plate extending from the other side of said positioning plate;

a crease line disposed at an outer edge of said inner movable plate defining a foldable outer end edge;

a plurality of transparent envelopes positioned by said positioning plate;

two reinforced ribs which are made of steel wire imbeded in two longer side edge portions of said foldable cover;

said reinforced ribs enwrapped by soft plastic cloth with woven designs;

wherein foldable outer end edge is turned upward to fasten an outer end edge of said outer movable plate, and wherein said outer movable plate and said positioning plate are inclined.

* * * * *